US007828589B2

(12) United States Patent
Cheng

(10) Patent No.: US 7,828,589 B2
(45) Date of Patent: Nov. 9, 2010

(54) CABLE ASSEMBLY WITH IMPROVED GROUNDING STRUCTURE

(75) Inventor: Yung-Chang Cheng, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/384,753

(22) Filed: Apr. 8, 2009

(65) Prior Publication Data

US 2009/0253291 A1 Oct. 8, 2009

(30) Foreign Application Priority Data

Apr. 8, 2008 (CN) ..... 2008 1 0023586

(51) Int. Cl.
*H01R 12/24* (2006.01)

(52) U.S. Cl. ..... 439/497; 439/452; 439/607.01

(58) Field of Classification Search ..... 439/497, 439/607.49, 579, 452, 607.01
See application file for complete search history.

(56) References Cited

U.S. PATENT DOCUMENTS 4,602,830 A * 7/1986 Lockard ..... 439/108
4,655,515 A * 4/1987 Hamsher et al. ..... 439/108
4,767,345 A * 8/1988 Gutter et al. ..... 439/92
6,053,770 A * 4/2000 Blom ..... 439/579
6,705,896 B1 3/2004 Chang
6,824,426 B1 * 11/2004 Spink, Jr. ..... 439/579
6,830,478 B1 * 12/2004 Ko ..... 439/579

* cited by examiner

*Primary Examiner*—Michael C Zarroli
(74) *Attorney, Agent, or Firm*—Wei Te Chung; Andrew C. Cheng; Ming Chieh Chang

(57) ABSTRACT

A cable assembly includes an electrical connector and a cable. The electrical connector includes an insulative housing having a first wall and a second wall, and a plurality of contacts received in the housing and at least a shell attached on the first wall of the housing. The cable includes at least a grounding wire and a plurality of signal wires connected to their corresponding contacts received in the housing. The shell includes at least a grounding portion extending from the shell and located between the shell and the second wall of the housing. The grounding portion includes a strain relief and a crimping portion. The grounding wire includes an inner contact crimped by the crimping portion and an insulative jacket crimped by the strain relief.

8 Claims, 3 Drawing Sheets

CABLE ASSEMBLY WITH IMPROVED GROUNDING STRUCTURE

BACKGROUND OF THE INVENTION

1. Field of the Invention

The present invention relates generally to a cable assembly, and more particularly to a cable connector with improved grounding structure.

2. Description of the Prior Art

A great deal of cable assemblies need to be grounded for achieving better signal-transmitting performance. U.S. Pat. No. 6,705,896 issued to Shih Tung Chang on Mar. 16, 2004, discloses a cable assembly including an insulative housing with a plurality of receiving slots, a shell covering the housing, a plurality of contacts received in the receiving slots of the housing and cable. The cable includes a plurality of signal wires terminated to the contacts and a plurality of grounding wires having larger diameter than the signal wires connected to the shell. The grounding wires are respectively located on the two sides of the signal wires to reduce the pull between the signal wires and the contacts of the connector. However, that the grounding wires are connected to the shell include the connector's thickness.

Hence, in this art, a cable assembly to overcome the above-mentioned disadvantages of the prior art should be provided.

BRIEF SUMMARY OF THE INVENTION

A primary object, therefore, of the present invention is to provide a cable assembly with improved grounding structure.

In order to implement the above object, the cable assembly made in accordance with the present invention comprises an electrical connector and a cable terminated thereto. The electrical connector comprises an insulative housing having a first wall and a second wall, and a plurality of contacts received in the housing and at least a shell attached on the first wall of the housing. The cable comprises at least a grounding wire and a plurality of signal wires connected to their corresponding contacts received in the housing. The shell comprises at least a grounding portion extending from the shell and located between the shell and the second wall of the housing. The grounding portion comprises a strain relief and a crimping portion. The grounding wire comprises an inner contact crimped by the crimping portion and an insulative jacket crimped by the strain relief.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
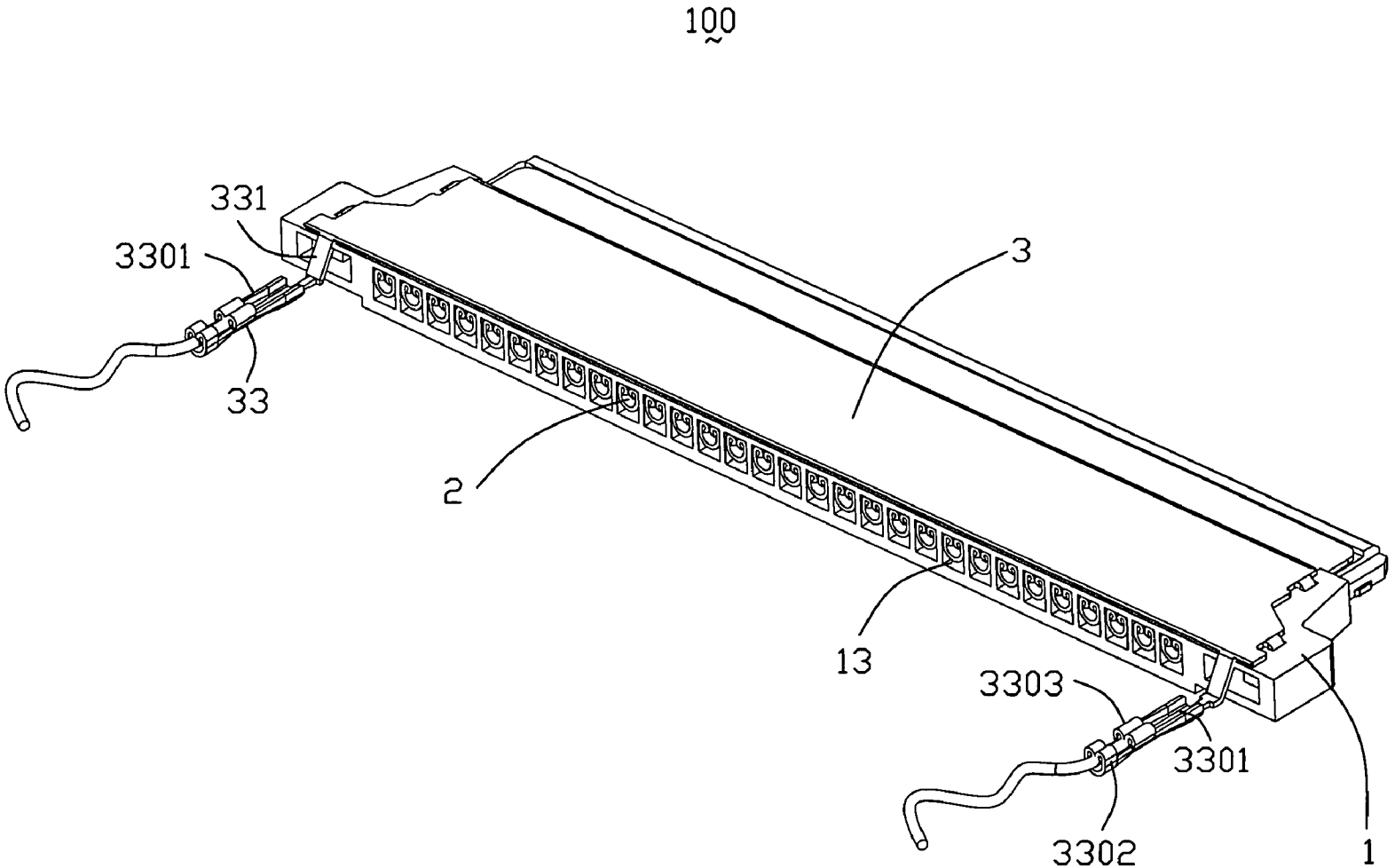
FIG. 1 is a perspective view illustrating a preferred embodiment of a cable assembly in according with the present invention.
Figure 2:
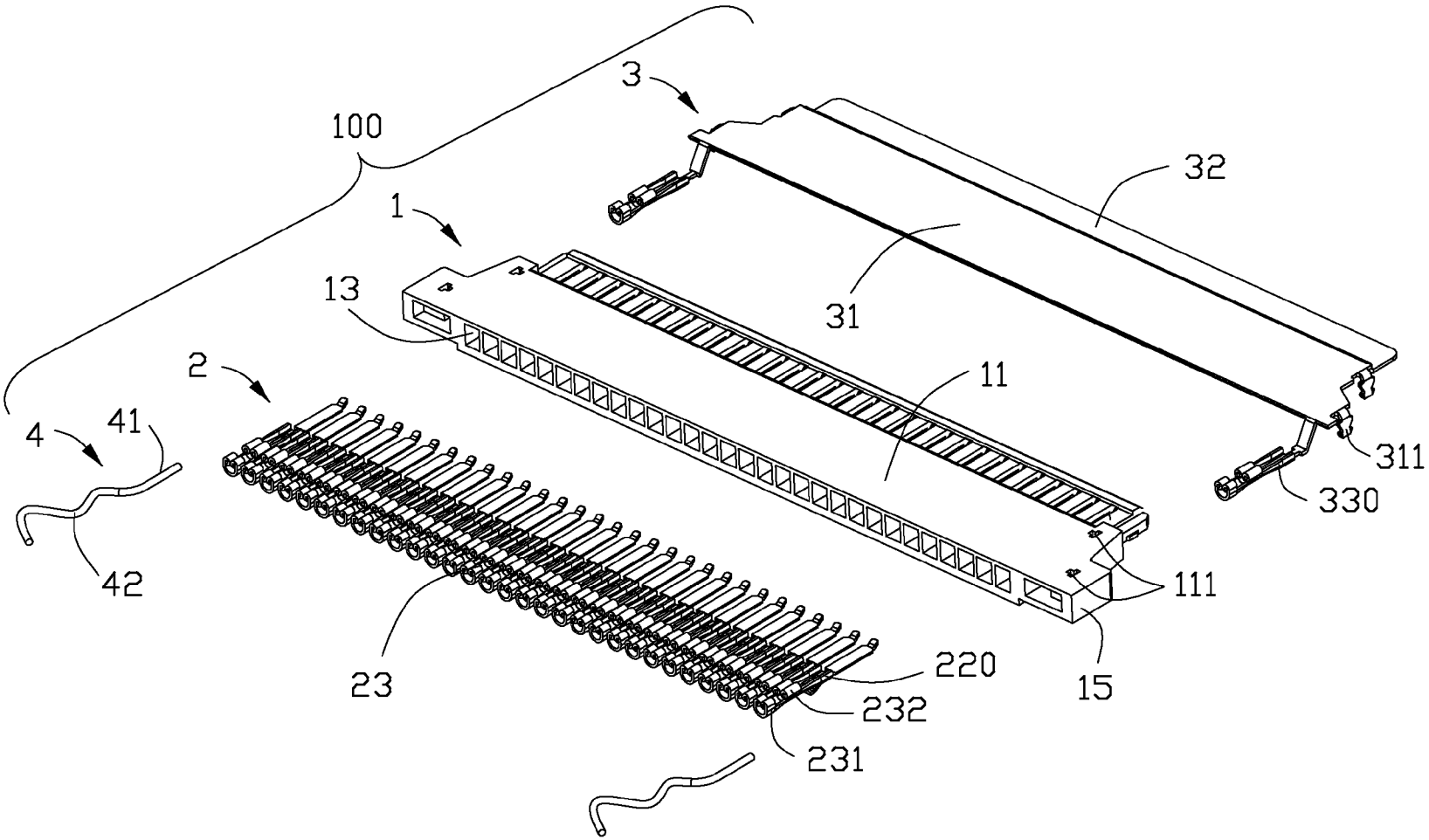
FIG. 2 is a exploded, perspective view of FIG. 1.
Figure 3:
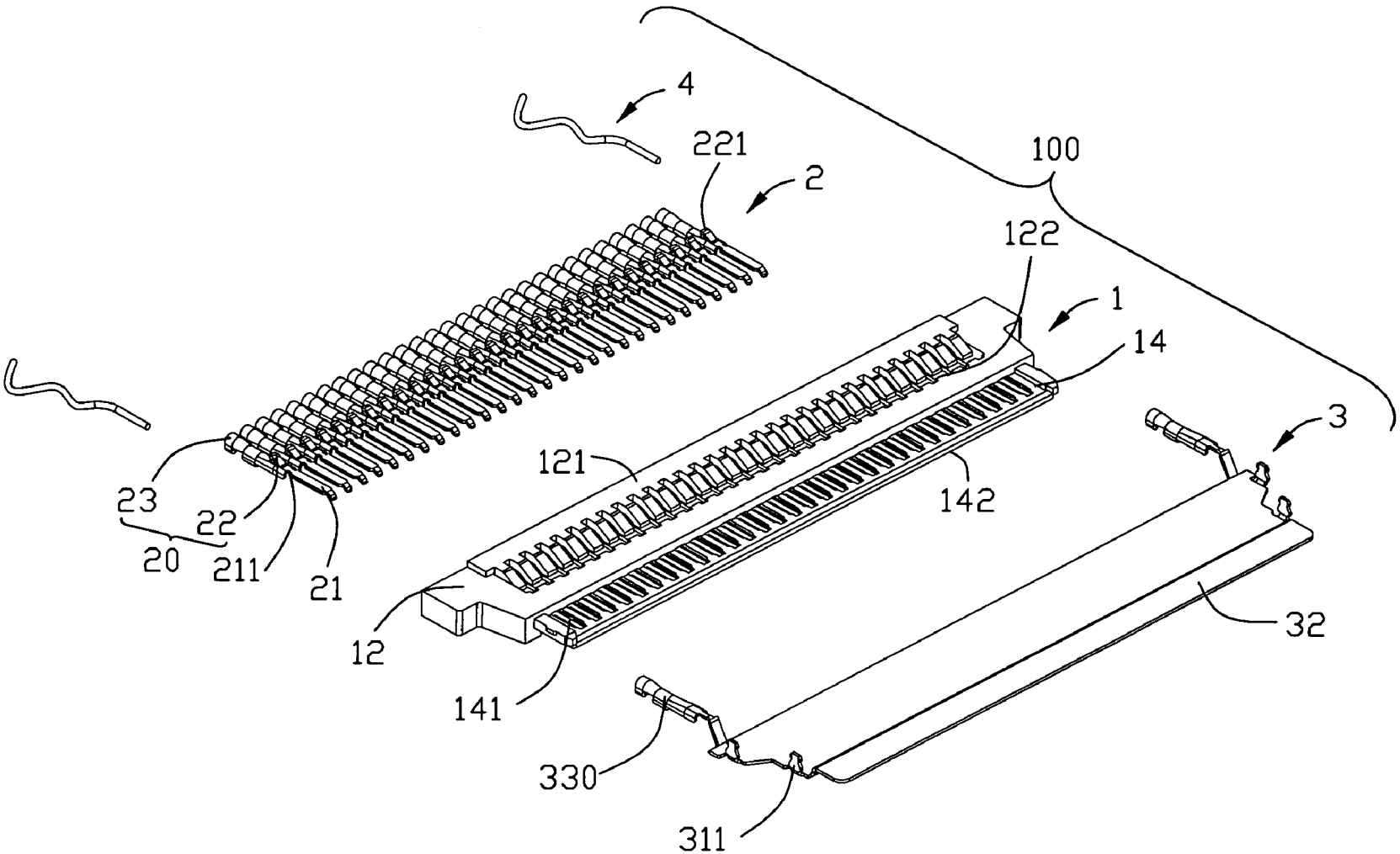
FIG. 3 is a view similar to FIG. 2, but viewed from another angle.

Reference to FIGS. 1 to 3, a cable assembly 100 in according with a preferred embodiment of the present invention is shown. The cable assembly 100 comprises an electrical connector and a plurality of conductive wires 4 terminated thereto. The electrical connector comprises an insulative housing 1, a plurality of contacts 2 received in the housing 1, and a shell 3 attached to the housing 1. The cables 4 comprises a plurality of signal wires (not shown) and a pair of grounding wires 42.

The housing 1 has a lower first wall 11, an upper second wall 12 opposite to the first wall 11 and a pair of side walls 15 connected to the first wall 11 and the second wall 12. The housing 1 comprises a main body 10 with a T-shaped configuration and a mating tongue 14 forward extending from the main body 10 to form a mating face 142 on the front thereof. A plurality of receiving grooves 13 is formed and equably engaged in the housing 1 and extends cross the housing 1 along a front-to-rear direction. A plurality of passages 141 is defined on the mating tongue 14 to correspond to and be respectively connected the receiving grooves 13. Two pair of locking holes 111 are respectively located on the two sides of the first wall 11 of the housing 1. A protuberant stage 121 upward extends from the second wall 12, and forms a flat roof 1210 and an inclined plane 1212 connected the flat roof 1210 and the second wall 12. A plurality of slots 122 extends from the flat roof 1210 with respectively corresponding to the receiving grooves 13 and crosses the inclined plane 1212 to be respectively connected to the receiving grooves 13.

Each of the contacts 2 is respectively received in the housing 1 and comprises a mating portion 21 received in its corresponding passage 142 of the mating tongue 14, and a main portion 20 received in the main body 10 of the housing 1. The main portion 20 comprises a tail portion 23 received in its corresponding receiving groove 13 of the housing 1 and a connecting portion 22 connecting the mating portion 21 to the tail portion 23. The connecting portion 22 comprises a receiving slot 220 and a spring pin 221 upward extending from the top thereof to be exposed in its corresponding slot 122 of the housing 1, and is connected to the mating portion 21 to form a gap 211. The tail portion 23 comprises a strain relief 231 on the rear end thereof and a crimping portion 232 on the front end thereof.

The shell 3 comprises a main section 31 covering the first wall 11 of the housing 1 and a extending section 32 covering the lower surface of the mating tongue portion 14. The main section 31 has two pair of locking legs 311 upward extending from the two sides thereof and a pair of grounding portion 33 rearward and upward extending from the two sides of the rear edge thereof. The locking legs 311 correspond to the two locking holes 111 of the housing and can be respectively inserted into the locking holes 111 to securely attach the shell 3 on the housing 1. Each of the grounding portions 33 comprises a connecting piece 331 rearward and downward extending from the rear edge of the main section 31 along a slantwise direction, and a grounding contact 330 connected to the connecting piece 331. The connecting piece 331 is positioned between the main section 31 of the shell 3 and the second wall 12 of the housing 1, and the connecting piece 331 and the grounding contact 330 would not increase the thickness of the cable assembly 100. The grounding contact 330 is configured similar to the structure of the contact 2 without mating portion 21 and spring pin 221, and comprises a receiving portion 3301 connected to the connecting piece 331, a strain relief 3302 and a crimping portion 3303 separated from the strain relief 3302. Obviously, the configuration of said grounding portion 33 is the same as the contact 2 without the spring pin 221.

Each of the wires comprises an inner conductor 41. Each wire is connected to its corresponding contact accompanied with the inner conductor 41 being crimped by the crimping portion 232, 3303. In other embodiment, the inner conductor 41 can be soldered on the connecting piece 331 of the grounding portion 33 while the grounding contact 33 can be omitted.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cable connector assembly, comprising: an electrical connector, comprising an insulative housing having a first wall and a second wall, a plurality of contacts received in the housing and at least a shell attached on the first wall of the housing; and a cable, comprising at least a grounding wire and a plurality of signal wires connected to their corresponding contacts received in the housing; said shell comprising at least a grounding portion rearward extending from the shell and exposed out of the shell and the housing, said grounding portion comprising a strain relief and a crimping portion, wherein said grounding portion comprises a connecting piece extending from the two sides of the rear edge of the shell and said grounding contact connected to the connecting piece.

2. The cable assembly as claimed in claim 1, wherein said each contact comprising a spring pin on the front end thereof, and the configuration of said grounding portion is the same as the contact without the spring pin.

3. The cable assembly as claimed in claim 1, wherein said each contact comprises a mating portion, a tail portion having a strain relief and a crimping portion, a connecting portion connecting the mating portion to the tail portion and having a receiving slot and a spring pin extending from the top thereof.

4. The cable assembly as claimed in claim 3, wherein said housing comprises a plurality receiving grooves receiving the tail portions and connecting portions of the contacts, and a mating tongue portion having a mating face and a plurality of passages receiving the mating portions of the contacts.

5. A cable connector assembly comprising:

an insulative longitudinal housing with two opposite ends along a longitudinal direction, and defining a plurality of side by side arranged passageways between said two opposite ends, each of said passageways extending along a front-to-back direction perpendicular to said longitudinal direction;

a plurality of contacts disposed in the corresponding passageways, respectively, each of said contacts defining a crimping type tail for securing to a corresponding wire; and a metallic shell mounted to the housing and unitarily forming a crimping type tang for securing to a corresponding wire; wherein said crimping type tang extends rearwardly beyond and exposed outside a rear face of the housing while said crimping type tail of the contact is fully protectively embedded within the corresponding passageway in front of the rear face.

6. The cable connector assembly as claimed in claim 5, wherein said shell is assembled to the housing along a vertical direction perpendicular to said longitudinal direction and said front-to-back direction.

7. The cable connector assembly as claimed in claim 6, wherein said crimping type tang extends rearwardly in a front-to-back direction so as to assure pulling forces derived from the corresponding wire and applied to the crimping type tang along said front-to-back direction will not influence securement of the shell to the housing due to assembling of the shell to the housing along the vertical direction perpendicular to said front-to-back direction.

8. A cable connector assembly comprising:

an insulative longitudinal housing with two opposite ends along a longitudinal direction, and defining a plurality of side by side arranged passageways between said two opposite ends, each of said passageways extending along a front-to-back direction perpendicular to said longitudinal direction;

a plurality of contacts disposed in the corresponding passageways, respectively, each of said contacts defining a crimping type tail for securing to a corresponding wire; and a metallic shell mounted to the housing and unitarily forming a crimping type tang for securing to a corresponding wire; wherein said shell is assembled to the housing along a vertical direction perpendicular to said longitudinal direction and said front-to-back direction; wherein said crimping type tang extends rearwardly in a front-to-back direction so as to assure pulling forces derived from the corresponding wire and applied to the crimping type tang along said front-to-back direction will not influence securement of the shell to the housing due to assembling of the shell to the housing along the vertical direction perpendicular to said front-to-back direction.

* * * * *